US005299773A

United States Patent [19]

Bertrand

[11] Patent Number: 5,299,773

[45] Date of Patent: Apr. 5, 1994

[54] MOUNTING ASSEMBLY FOR A POLE

[76] Inventor: Ruston Bertrand, P.O. Box 133, Baldwin, La. 70514-0133

[21] Appl. No.: 913,801

[22] Filed: Jul. 16, 1992

[51] Int. Cl.[5] ..... B63B 45/04

[52] U.S. Cl. ..... 248/514; 248/534; 248/289.1; 362/427; 362/431

[58] Field of Search ..... 248/289.1, 282, 514, 248/218.4, 534; 362/431, 427

[56] References Cited

U.S. PATENT DOCUMENTS

| | | | |
|---|---|---|---|
| 2,740,039 | 3/1956 | Phillips | 362/427 X |
| 3,833,800 | 9/1974 | Stewart et al. | 362/61 |
| 3,941,340 | 3/1976 | Rankins | 248/514 |
| 3,964,706 | 6/1976 | Adams | 248/534 X |
| 4,395,749 | 7/1983 | Poveromo | 362/427 X |
| 4,473,873 | 9/1984 | Quiogue | 248/324 X |
| 4,884,173 | 11/1989 | Cassidy | 362/427 X |

*Primary Examiner*—Eugenia Jones
*Attorney, Agent, or Firm*—Keaty & Keaty

[57] ABSTRACT

The invention relates to a mounting assembly for a pole, such as a pole light conventionally carried by a stern of boat hulls. The mounting assembly provides for the use of a ratchet mechanism having a pair of cooperating members, with the pole being secured to one of the ratchet members. A bracket secures the ratchet mechanism to a stable body, such as the hull of a ship, or the housing of a motor. The pole can be positioned in any of a plurality of selected positions by rotating the pole against the engagement of the ratchet teeth between the two members. A spring continuously pulls one ratchet member against the second ratchet member, preventing disengagement thereof, while allowing a limited lateral movement between the ratchet members.

8 Claims, 1 Drawing Sheet

MOUNTING ASSEMBLY FOR A POLE

BACKGROUND OF THE INVENTION

The present invention relates to mounting assemblies for pole or pole lights, such as for example navigation lights for boats. More specifically, the present invention relates to a mounting assembly which allows to position the pole light assembly at any of the selected angles about a circumference of a rotational plane.

It is a requirement in the operation of small crafts to have a light assembly for use at night or during inclement weather, so as to allow other boat operators to identify the position of a particular boat on water. For this purpose, a stern light is usually positioned on the hull of a boat, such that the pole carrying a light assembly extends upwardly from the hull in a substantially perpendicular manner. In some cases, however, it is convenient to change the position of the pole, i.e. to move it away from the vertical position during non-use.

To solve the problem, various designs have been offered. Some of them allow removal of the boat light from the base assembly when not in use. One of such examples is disclosed in U.S. Pat. No. 3,833,800 issued on Sep. 3, 1974 to Stewart et al and entitled "Boat Pole Light Base Assembly". In that patent, a cover plate of the base assembly urges a locking clip against the light pole to frictionally secure the pole within the base plate bore. When the pole is removed, the cover plate is slidable to cover the bore and is locked in a covering position by the locking clip member.

Such an arrangement presents certain disadvantages, since the pole light, to make the assembly convenient for the user, has to be removed and stored some place else.

The present invention contemplates elimination of drawbacks associated with the known devices and provision of an adjustable mounting assembly for securing a pole, such as a pole for a boat light.

SUMMARY OF THE INVENTION

It is, therefore, an object of the present invention to provide a mounting assembly which allows selective positioning of a pole in a plurality of positions away from the vertical.

It is another object of the present invention to provide a mounting assembly for a pole which securedly engages that pole and prevents its disengagement even during vibration of the main body to which the mounting assembly is attached.

It is a further object of the present invention to provide a mounting assembly for a pole light which is easy to operate and inexpensive to manufacture.

These and other objects of the present invention are achieved through a provision of a mounting assembly for a pole which comprises a mounting bracket adapted for secure attachment to a stable body and a means for positioning the pole in any of a plurality of selected positions in relation to the stable body, while allowing rotation of the pole in relation to the bracket.

The means for positioning the pole in a plurality of the selected positions comprise a ratchet mechanism having a first member and a second member, each of which has radially extending spaced-apart teeth formed on the contact surfaces. The teeth intermesh and prevent free rotation of the ratchet members in relationship to each other through the use of a tension spring which pulls the second ratchet member against the first ratchet member and prevents disengagement of the ratchet members, once the angular position of the pole is selected. At the same time, one of the ratchet members is allowed a limited lateral movement in relation to another fixed ratchet member. The second ratchet member can rotate 360 degrees in either clockwise or counter-clockwise direction when torque is applied to the pole, with the pole being fixedly attached to the second ratchet member.

An elongated exteriorly threaded stud extends through central openings of the bracket and the first and the second ratchet members, one end of the stud carrying a locking nut, with the second end of the stud being fixedly attached to the rotatable, movable ratchet member. The tension spring urges against a surface of the bracket at one of its ends, and against the locking-nut at its opposite end. The bracket is provided with outwardly extending plates, or flanges, which are secured to a stable body by screws, or the like. A free end of the pole can carry a boat light, or any other desired assembly.

These and other features of the present invention will be more apparent to those skilled in the art from the following detailed description of the invention.

BRIEF DESCRIPTION OF THE DRAWINGS

Reference will now be made to the drawings, wherein like parts are designated by like numerals, and wherein.

DETAILED DESCRIPTION OF THE PREFERRED EMBODIMENT

Figure 3:
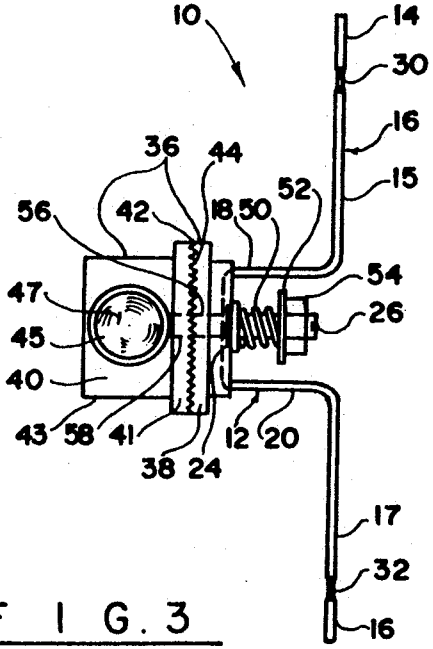
FIG. 3 is a plan view of the mounting assembly in accordance with the present invention.

Referring now to the drawings in more detail, the mounting assembly in accordance with the present invention is generally designated by numeral 10. The assembly 10 comprises a generally U-shaped bracket 12 having a pair of securing plates 14 and 16 extending outwardly from the outer ends of the bracket 12 in a substantially opposing relationship. The bracket 12 comprises a pair of parallel side walls 18 and 20 and a transverse connecting wall 22. The plates 14 and 16 extend in a substantially parallel relationship to the wall 22, as can be better seen in FIG. 3.

A central opening 24 is made through the wall 22 and is sized and shaped to receive an elongated externally threaded stud 26 therethrough. The plate 14 has an opening 30 adjacent to its outer end, and the plate 16 has a similar opening 32 adjacent its outer end. The openings 30 and 32 are designed to receive securing bolts for securing the mounting assembly 10 to a fixed, stable body, as will be explained in more detail hereinafter.

The mounting assembly 10 further comprises a ratchet mechanism 36 which is comprised of two elements: a first ratchet member 38 which contacts the transverse wall 22 and a second ratchet element 40 which engages the first element 38 through the contact surface 42. A similar contact surface 44 is made on the first ratchet element 38, each of the surfaces 42 and 44 being provided with a plurality of radially extending spaced-apart meshing teeth which, when engaged, prevent relative rotation between the first member 38 and the second member 40, unless a rotational force is applied to move the teeth from their intermeshed engagement with each other and reposition the second ratchet member 40 in relation to the first ratchet member 38.

To further insure a relative engagement between the ratchet members 38 and 40, a spring means 50 is mounted in a circumferential relationship about a stud 26 and urges against the transverse wall 22, continuously urging and pulling the second ratchet member 40 into engagement with the first ratchet member 38.

The second end of the coil spring 50 abuts a washer 52 which is mounted in a circumferential relationship on the stud 26 a distance from the transverse wall 22. A lock nut 54 which is threadably engaged with a distal end of the stud 26 prevents movement of the washer 52 and insures that the spring 50 is in a substantially compressed position to urge the second ratchet member into a "gear" engagement with the first ratchet member 38.

The stud 26 extends through corresponding openings 56 and 58 through the center of the first ratchet member 38 and the second ratchet member 40, respectively. The proximal end of the stud 26 is fixedly attached, such as by spot-welding, to the second ratchet member at 41, thereby allowing the spring 50 to exert a continuous pulling force on the second member 40.

As can be further seen in FIG. 3, the second ratchet member 40 comprises a transversely extending pole engaging bushing 43. The bushing 43 is formed with an opening 45 which is sized and shaped to receive an elongated pole 60 in a tight frictional engagement therein. The opening 45 does not need to extend all the way through the bushing 43, but can terminate in a bottom wall 47. One end of the pole 60 will then contact the bottom 47, with the pole 60 being secured in a fixed relationship to the bushing 43. If desired, the pole 60 can be engaged by screws or by welding to the bushing 43 to prevent its disengagement therefrom.

Figure 2:
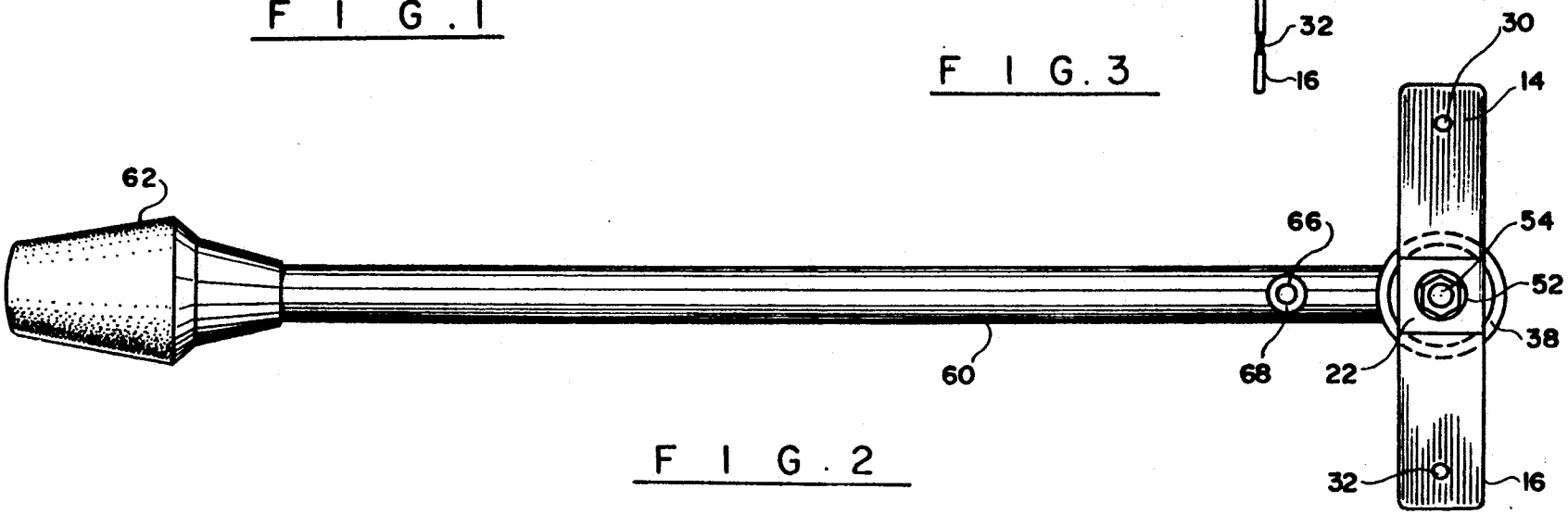
FIG. 2 is a plan view of the mounting assembly with a pole light secured therewith.

Turning now to FIG. 2 of the drawings, the pole 60 is seen to carry a light assembly 62 on its free end, the light assembly being provided with corresponding wires extending through the hollow tubing of the pole 60, the wires 64 leaving the pole 60 through a specially provided opening 66 made in the body of the tubing. If desired, a rubber grommet 68 can be fitted within the opening 66 to prevent contact of wires with a metal tubing of the pole 60.

Figure 1:
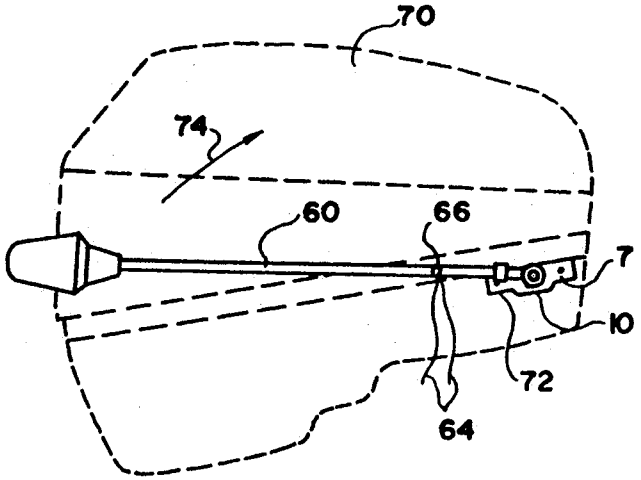
FIG. 1 is a perspective view illustrating an exemplary manner of positioning the mounting assembly on a boat motor housing.

When in use, the mounting assembly 10 is secured to a fixed body, such as for example the housing 70 of a boat motor (see FIG. 1) by screws 72 or the like, passing through the openings 30, 32. The inner surfaces 15 and 17 of the plates 14 and 16, respectively, contact the housing 70, while the bracket 12 extends outwardly therefrom and supports the pole 60 and the associated light assembly 62 a short distance away from the housing.

When not in use (see FIG. 1), the pole 60 is manually moved into a position away from the vertical by grasping the pole 60 and rotating the second ratchet element 40 in relationship to a fixed bracket 12 and the fixed first ratchet element 38. Since the teeth 32 and 34 intermesh regardless of the position of the pole 60 in relationship to the fixed bracket 12, and the spring 50 continues to force the teeth 42 and 44 into an intermeshed engagement, the pole 60 can be rotated and left in that position at any degree of rotation in relationship to the plane of the housing 70, about 360 degree circumference.

When it is required that the light 62 be displayed above the deck of the boat (not shown) the pole 60 is manually rotated in the direction of arrow 74 until it reaches an upwardly extending position (not shown). The pole can be easily rotated in a clockwise or counter-clockwise direction.

As will be appreciated, the mounting assembly in accordance with the present invention can be used for securing other poles, such as flag poles, signal posts, and the like. In any event, the position of the pole 60 can be adjusted and selected from any desired position about 360 degree circumference. During operation or non-use of the device, the mounting assembly 10 securely holds the pole 60 not requiring its removal, while conveniently moving it away from the outwardly extending position, when desired.

Many changes and modifications can be made within the design of the present invention, without departing from the spirit thereof. I, therefore, pray that my rights to the present invention be limited only by the scope of the appended claims.

I claim:

1. A mounting assembly for a pole, comprising:

a mounting bracket means comprising means for attaching the bracket means to a stable body;

a means for positioning the pole in any of a plurality of selected positions in relation to the stable body, while allowing rotation of the pole in relation to the bracket means, said positioning means comprising a ratchet mechanism comprising a first member securely attached to the bracket means and a second member frictionally engageable with the first member, said second member being adapted for rotational movement about a central axis thereof, said second member carrying one end of the pole in a fixed engagement therewith; and means for preventing disengagement of the second member from the first member, while allowing a limited lateral movement of the second member in relation to the first member, wherein said means for preventing disengagement comprise an elongated stud extending through central openings of said first member, said second member and said bracket means, one end of said stud being fixedly attached to said second member, and an opposite end of the stud carrying a nut.

2. A mounting assembly for a pole, comprising:

a mounting bracket means comprising a means for attaching the bracket means to a stable body, said bracket means comprising a generally U-shaped bracket having a pair of parallel walls and a transverse connecting wall, and a pair of opposing attachment plates extending outwardly from free ends of the parallel walls in substantially parallel relationship to the transverse wall, said attachment plates being adapted for a fixed attachment to the stable body;

a means for positioning the pole in any of a plurality of selected positions in relation to the stable body, while allowing rotation of the pole in relation to the bracket means, said positioning means comprising a ratchet mechanism comprising a first member securely attached to the bracket means and a second member frictionally engageable with the first member, said second member being adapted for rotational movement about a central axis thereof, said second member carrying one end of the pole in a fixed engagement therewith; and means for continuously urging said first member and said second member into frictional engagement, said means for urging comprising a spring means exerting a pulling force on said second member, and wherein the first member, the second member and the transverse wall each having a central opening, and wherein an elongated stud is received in each of said openings, one end of the stud being fixedly attached to the second member, while the opposite end of the stud extends a distance outwardly from the transverse wall.

3. The device of claim 2, wherein a locking nut is threadably engaged with the opposite end of the stud a distance from the transverse wall.

4. The device of claim 3, further comprising a tension spring means mounted in circumferential relationship about the elongated stud for exerting a pulling force on the second member.

5. The device of claim 4, wherein one end of the spring means urges against the transverse wall of the bracket, while an opposite end of the spring means urges against the locking nut.

6. A mounting assembly for a light pole, comprising:

a mounting bracket means comprising a means for attaching the bracket means to a stable body;

a means for positioning the pole in any of a plurality of circumferentially selectable positions, while allowing rotation of the pole in relation to the bracket means, said positioning means comprising a ratchet mechanism comprising a first member and a second member, with the pole being fixedly attached to the second member, said first member comprising a first circular plate having a plurality of radially extending spaced-apart teeth formed on that surface of the plate which contacts the second member, said second member comprising a second circular plate having a plurality of radial extending spaced-apart teeth which intermesh with the teeth of the first member, while allowing rotation of the second member when torque is applied to the pole, said bracket means, said first member and said second member being each provided with central openings extending therethrough; and means for preventing disengagement of the second member from the first member, while allowing a limited lateral movement of the second member in relation to the first member, and wherein said means for preventing disengagement comprise an elongated stud extending through the central openings of the first member, the second member and the bracket means, one end of said stud being fixedly attached to the second member, and an opposite end of the stud carrying a locking nut.

7. The device of claim 6, further comprising means for continuously urging the second member into frictional contact with the first member.

8. The device of claim 7, wherein said means for urging said second member into contact with the first member comprises a tension spring means exerting a pulling force on the second member, said tension spring means being mounted in circumferential relationship about said elongated stud, said spring means urging against the bracket means and the locking nut.

* * * * *